US009725837B2

(12) United States Patent
Catallo

(10) Patent No.: US 9,725,837 B2
(45) Date of Patent: Aug. 8, 2017

(54) SHOE FOR A COMPACTOR AND FOR AVOIDING HEAT DEFORMATION THEREOF

(71) Applicant: Teresa Catallo, Old Westbury, NY (US)

(72) Inventor: Frank Catallo, Old Westbury, NY (US)

(73) Assignee: Teresa Catallo, Old Westbury, NY (US)

( * ) Notice: Subject to any disclaimer, the term of this patent is extended or adjusted under 35 U.S.C. 154(b) by 293 days.

(21) Appl. No.: 14/554,223

(22) Filed: Nov. 26, 2014

(65) Prior Publication Data

US 2016/0145788 A1 May 26, 2016

(51) Int. Cl.
*D06C 21/00* (2006.01)

(52) U.S. Cl.
CPC ..... *D06C 21/00* (2013.01)

(58) Field of Classification Search
CPC ..... D06C 21/00; D06C 15/04; D06C 7/00; D06C 15/00; D06C 7/02; D21F 3/0218; D21F 3/0272; D21G 3/00; D21G 3/005; D21G 3/02; B31F 1/12; B31F 1/14; B31F 1/145; D06F 65/00; D06F 65/10
USPC ..... 26/18.6; 28/138, 139; 162/206, 281, 162/295, 111
See application file for complete search history.

(56) References Cited

U.S. PATENT DOCUMENTS 1,473,364 A * 11/1923 Voelker ..... D06C 15/04 38/66
1,751,471 A 3/1930 Campbell
2,021,975 A * 11/1935 Wrigley ..... D06C 21/00 26/18.6
2,263,712 A 11/1941 Wrigley
3,015,145 A 1/1962 Cohn
3,015,146 A 1/1962 Cohn
3,195,213 A * 7/1965 Wehrmann ..... D06C 21/00 26/18.6
3,220,056 A * 11/1965 Walton ..... B31F 1/122 26/18.6
3,235,933 A * 2/1966 Catallo ..... D06C 21/00 162/111
3,236,718 A 2/1966 Cohn
3,260,778 A * 7/1966 Walton ..... B31F 1/14 26/18.6
3,431,608 A * 3/1969 Reiners ..... D06C 21/00 226/5
3,471,907 A 10/1969 Beckers
3,973,303 A 8/1976 Diggle
(Continued)

FOREIGN PATENT DOCUMENTS

GB 997879 A * 7/1965 ..... B21C 23/005

*Primary Examiner* — Amy Vanatta
(74) *Attorney, Agent, or Firm* — Charles E. Baxley

(57) ABSTRACT

An improved compactor shoe of the type having a gull-wing shape formed by a first wing and a second wing that meet at a critical lower edge, and a top surface. The first wing has a first radius of curvature and the second wing has a second radius of curvature, and both depend concavingly from the top surface to the critical lower edge. The first radius of curvature of the first wing is less than the second radius of curvature of the second wing. The improvement includes a through bore extending axially through the shoe, which carries a coolant to avoid heat deformation of the critical lower edge.

18 Claims, 5 Drawing Sheets

(56) References Cited

U.S. PATENT DOCUMENTS

| | | | | | |
|---|---|---|---|---|---|
| 4,118,841 | A | | 10/1978 | Diggle | |
| 4,142,278 | A | * | 3/1979 | Walton | D06C 21/00 26/18.6 |
| 4,227,288 | A | | 10/1980 | Moser | |
| 4,363,161 | A | | 12/1982 | Catallo | |
| 4,447,938 | A | | 5/1984 | Catallo | |
| 4,689,862 | A | | 9/1987 | Catallo | |
| 4,894,196 | A | * | 1/1990 | Walton | B31B 1/00 162/111 |
| 4,959,893 | A | * | 10/1990 | Catallo | D06C 21/00 165/90 |
| 5,012,562 | A | * | 5/1991 | Catallo | D06C 21/00 26/18.5 |
| 5,553,365 | A | * | 9/1996 | Catallo | D06C 21/00 26/18.6 |
| 6,681,461 | B1 | * | 1/2004 | Catallo | D06C 21/00 26/18.6 |

* cited by examiner

SHOE FOR A COMPACTOR AND FOR AVOIDING HEAT DEFORMATION THEREOF

1. BACKGROUND OF THE INVENTION

A. Field of the Invention

The embodiments of the present invention relate to a shoe for a compactor, and more particularly, the embodiments of the present invention relate to a shoe for a compactor and for avoiding heat deformation thereof.

B. Description of the Prior Art

A number of different machines have been proposed to effect a compressive force on fibrous webs in order to impart pre-shrinkage properties to the material, which will be described below in chronological order to show advancement in the art, and which are incorporated herein by reference thereto in their entirety. Even though these innovations may be suitable for the specific individual purposes to which they address, nevertheless, they differ from the embodiments of the present invention in that they do not teach a shoe for a compactor and for avoiding heat deformation thereof.

(1) U.S. Pat. No. 1,751,471 to Campbell.

U.S. Pat. No. 1,751,471—issued to Campbell on Mar. 25, 1930—teaches a creeping mechanism including an apparatus for forwardly feeding a web of paper, and creping devices associated with the feeding apparatus and in closely spaced relation to one another to furnish a restricted channel for the retarded passage of the paper web. One of the walls of the channel is of a yielding character to accommodate variations in thickness of the paper web.

(2) U.S. Pat. No. 2,263,712 to Wrigley et al.

U.S. Pat. No. 2,263,712—issued to Wrigley et al. on Nov. 25, 1941 in U.S. class 26 and subclass 18.6—teaches a method of shrinking textile fabric material, which includes causing the material to travel lengthwise, reducing the speed at which the material travels at one point in a direction of travel in comparison with that at an earlier point, and between the points, confining the fabric sufficiently to prevent it from buckling as a whole but with freedom over its entire surface to slip relative to a confining apparatus for self-adjustment to become thicker and shorter.

(3) U.S. Pat. No. 3,015,145 to Cohn et al.

U.S. Pat. No. 3,015,145—issued to Cohn et al. on Jan. 2, 1962 in U.S. class 26 and subclass 18.6—teaches an apparatus including a feeding roller, an apparatus to drive the feeding roller at a first predetermined uniform peripheral speed, a retarding roller, and an apparatus to drive the retarding roller at a second predetermined uniform peripheral speed. The second peripheral speed is related to, and is slower than, the first peripheral speed. The feeding and retarding rollers are mounted to form a nip and have surface characteristics so that the retarding roller has a more positive grip than the feeding roller on a material passing through the nip. The apparatus further includes a confining shoe positioned adjacent the feeding roller and has an arcuate confining surface extending over a substantial arcuate surface portion of the feeding roller. The feeding roller and the confining surface form a confined path for passage of a material in a positive frictional engagement with the feeding roller. The confining shoe has a terminating edge positioned at a predetermined distance from the nip. The predetermined distance is substantially less than the length of the confined path. The feeding roller and the portion of the shoe in the immediate region of the terminating edge form an entry of a treating zone, while the nip forms an exit of the treating zone. The treating zone accommodates a substantial increase in thickness of the material emerging from the confined path, whereby lengthwise compression of the material is limited to the treating zone. The apparatus still further includes an apparatus to heat the rollers.

(4) U.S. Pat. No. 3,015,146 to Cohn et al.

U.S. Pat. No. 3,015,146—issued to Cohn et al. on Jan. 2, 1962 in U.S. class 26 and subclass 18.6—teaches an apparatus for forcible compressive shrinkage of tubular knitted fabric in the longitudinal direction, which includes a first compressive shrinking station having first feeding and retarding rolls forming a first nip, a first shoe forming with the first nip a first compressive shrinking zone, a second compressive shrinking station having second feeding and retarding rolls forming a second nip, a second shoe forming with the second nip a second compressive shrinking zone, an apparatus to supply the fabric to the first feeding roll, whereby one surface of the fabric contacts the first feeding roll. The second compressive shrinking station is reversely oriented with respect to the first compressive shrinking station, whereby the second feeding roll is arranged to contact the other surface of the fabric. The apparatus further includes an apparatus to drive the first feeding and the retarding rolls, and an adjustable apparatus for driving the second feeding and the retarding rolls in a predetermined speed relation to the first feeding and the retarding rolls, whereby the second feeding roll is driven at a peripheral speed greater than that of the first retarding roll to effect a controlled lengthening of the fabric traveling between the compressive shrinking stations.

(5) U.S. Pat. No. 3,236,718 to Cohn et al.

U.S. Pat. No. 3,236,718—issued to Cohn et al. on Feb. 22, 1966 in U.S. class 161 and subclass 128—teaches an apparatus including a pair of rolls mounted for rotation about parallel axes and adjustable toward, and away from, each other to form a nip of desired dimensions. The first roll constitutes a feeding roll and is adapted to be driven at a predetermined adjustable speed. The second roll constitutes a retarding roll and is also adapted to be driven at a predetermined adjustable speed that is somewhat slower than that of the feeding roll. A material confining-shoe is mounted in predetermined adjustable relation to the feeding and the retarding rolls and has an arcuate lower surface that is substantially concentric with the outer surface of the feeding roll. The shoe has a terminating edge that is positioned between the feeding and the retarding rolls a predetermined adjustable distance above the nip, with the nip lying in a plane containing the axes of the rolls.

(6) U.S. Pat. No. 3,431,608 to Reiners.

U.S. Pat. No. 3,431,608—issued to Reiners on Mar. 11, 1969 in U.S. class 26 and subclass 18.6—teaches an apparatus for compacting a fibrous material web, which includes two rolls defining a compacting gap, and an elongated nozzle of uniform cross section extending parallel to axes of the rolls and directed towards the gap discharge end to provide a pressurized fluid cushion supplies pressurized fluid to the nozzle and has a volume compared to the nozzle volume that affords substantially constant fluid pressure distribution along the entire nozzle length. A device is located in the container upstream of the nozzle for maintaining constant pressure of fluid issuing from the nozzle.

(7) U.S. Pat. No. 3,471,907 to Beckers.

U.S. Pat. No. 3,471,907—issued to Beckers on Oct. 14, 1969 in U.S. class 26 and subclass 18.6—teaches an apparatus for longitudinally or transversely compacting a fibrous material web, which includes rotary first and second rolls having exterior surfaces spaced a given gap distance from one another, so that a web transported between the rolls is in continuous contact with the exterior surfaces, a pair of side members, respectively, situated at opposite ends of, and adjacent to, the gap between the rolls and, respectively, having concave slide surfaces with curvatures corresponding to those of the exterior roll surfaces directed toward the latter to define additional gaps therebetween through which the web travels.

(8) U.S. Pat. No. 3,973,303 to Diggle Jr.

U.S. Pat. No. 3,973,303—issued to Diggle Jr. on Aug. 10, 1976 in U.S. class 26 and subclass 18.6—teaches an on-line adjustment of a length of a compressive shrinking zone in a two roll compactor. A compactor shoe is supported at each end by a pair of primary levers arranged to pivot around an axis of a feeding roll. By movement of the primary levers, the tip of the compacting shoe forming an upstream end of the compressive shrinking zone is movable toward, or away from, a roller nip formed by opposed feeding and retarding rollers and constituting a downstream end of the compressive shrinking zone. An adjustment feature enables the operator to effect adjustment of the position of the shoe tip, while the equipment is in full speed operation, so that processing of materials in the compactor may be optimized.

(9) U.S. Pat. No. 4,118,841 to Diggle Jr.

U.S. Pat. No. 4,118,841—issued to Diggle Jr. on Oct. 10, 1978 in U.S. class 26 and subclass 18.6—teaches mechanical compacting of woven gauze bandages. A bandage gauze having increased crimp and bulk and a degree of lengthwise stretch is produced by passing the gauze through a two-roll compactor which, in its generalities, is of a known type, but which is specifically modified to enable the gauze material to be processed. The compactor includes opposed feeding and retarding rolls forming a nip. A compacting shoe is associated with the feed roll and the roller nip so as to drive the fabric to be fed toward the nip. At the nip, the gauze is decelerated by the retarding roll and the material is continuously and progressively gathered and compacted in a short zone between the terminal edge or tip of the shoe and the roller nip. The ability to process gauze bandage material in a two-roll compactor is made possible by use of a combination of compactor rolls including a retarding roll formed with a diamond knurled surface and a feeding roll formed with a straight knurled surface of somewhat finer pitch than the diamond knurl of the retarding roll. The feeding roll is provided with a surface-forming apparatus at each end thereof projecting radially beyond the working surface of the feeding roll to act as a limit stop for the compacting shoe. The compacting shoe is positioned in a spaced relation to the working surface of the feeding roll by the limit stop.

(10) U.S. Pat. No. 4,142,278 to Walton et al.

U.S. Pat. No. 4,142,278—issued to Walton et al. on Mar. 6, 1979 in U.S. class 26 and subclass 18.6—teaches a machine and method for longitudinal compressive treatment of webs employing a two roll drive nip. Specially arranged initial parts of one or a pair of stationary retarding members are positioned at an exit side of the drive nip in a region of minor divergence of roll surfaces to provide damming forces. An initial part of the retarding member, preferably, a curved and resilient nipping element, is shaped to oppose flow of the web. By its construction and position close to the line of centers of the rolls, it establishes a compacted column extending upstream to an initial treatment point continually located in the drive nip between the moving surfaces of the rolls. In this region, longitudinal compressive action occurs upon the web in a continuous and uniform manner, preferably, with compensatory action in response to variations in forces exerted by the compacted column of web. This compensatory action is provided by resilient deformation of a retarding member in the direction normal to the plane of the web, resilient adjustment movement of a retarding member in the direction away from the nip roll center line, and in some cases, by resilient response of the compacted material itself. The retarding members may accomplish their resilient movement by swinging about the roll axes and by moving longitudinally of the web flow path. The retarding member, or the leading member of a pair, preferably, in the start-up position, has its initial part located upstream of the running position.

(11) U.S. Pat. No. 4,227,288 to Moser.

U.S. Pat. No. 4,227,288—issued to Moser on Oct. 14, 1980 in U.S. class 26 and subclass 18.6—teaches a mechanical compressive shrinkage apparatus of the type including opposed feeding and retarding rollers arranged for cooperation with a confining shoe. Fabric, or the like, is advanced over the feeding roller and is maintained in contact therewith by the confining shoe. The feeding and the retarding rollers are arranged to form a nip. The fabric enters the nip immediately after its emergence from between the feeding roller and the confining shoe. The retarding roller, moving at a slightly slower rate of speed than the feeding roller and having a superior grip on the fabric, causes the fabric to be decelerated at the nip and mechanically compacted between the nip and the confining shoe. The confining shoe includes a rigid support beam to which are secured a plurality of contoured shoe segments whose lengths are a fraction of the length of the rigid support beam. A thin and contoured liner element is secured over the working faces of the shoe segments forming a continuous and uninterrupted working surface arranged for contact with the fabric. The liner plate is arranged for replacement to accommodate wear.

(12) U.S. Pat. No. 4,363,161 to Catallo.

U.S. Pat. No. 4,363,161—issued to Catallo on Dec. 14, 1982 in U.S. class 26 and subclass 18.6—teaches an apparatus for compressing a web of fibrous material. The apparatus includes a first surface movable in one direction and a second surface movable in an opposite direction at a speed slower than the speed of movement of the first surface. Confining apparatus has an apex and extends between the surfaces. A stuffing chamber is formed between the two surfaces and the confining apparatus. Movement of the first surface feeds a web of material into the stuffing chamber, and movement of the second surface moves compressed material out of the stuffing chamber. Also taught is a method of compressing the web of fibrous material where the material is forced into the stuffing chamber formed between the confining apparatus having an apex and first and second surfaces. The web of material is fed into the stuffing chamber by moving one of the surfaces in one direction at a particular speed. Compressed material is removed from the stuffing chamber by moving the second surface in a direction opposite to that of the first surface and at a slower speed than that of movement of the first surface.

(13) U.S. Pat. No. 4,447,938 to Catallo.

U.S. Pat. No. 4,447,938—issued to Catallo on May 15, 1984 in U.S. class 26 and subclass 18.6—teaches an apparatus for compressing a web of fibrous material. The apparatus includes a first surface movable in one direction and a second surface movable in an opposite direction and at a speed slower than the speed of movement of the first surface. Confining apparatus has an apex and extends between the first and the second surfaces. A stuffing chamber is formed between the first and the second surfaces and the confining apparatus. Movement of the first surface feeds a web of material into the stuffing chamber and movement of the second surface moves compressed material out of the stuffing chamber. Also taught is a method of compressing the web of fibrous material where the material is forced into the stuffing chamber formed between the confining apparatus having an apex and the first and the second surfaces. The web of material is fed into the stuffing chamber by moving one of the first and the second surfaces in one direction at a particular speed. Compressed material is removed from the stuffing chamber by moving the second surface in a direction opposite to that of the first surface and at a slower speed than that of movement of the first surface.

(14) U.S. Pat. No. 4,689,862 to Catallo.

U.S. Pat. No. 4,689,862—issued to Catallo on Sep. 1, 1987 in U.S. class 26 and subclass 18.6—generally teaches a method and apparatus for compressive treatment of material. The method and apparatus use a gull winged confining apparatus in conjunction with two surfaces to form a stuffing chamber. The wing of the confining apparatus that faces the first and faster moving surface is provided with a precompacting zone where the wing and the first moving surface are spaced more than at other positions between the wing and the first moving surface.

Specifically, referring now to the figures of the drawing, in which like numerals indicate like parts, and particularly to FIG. 1 that teaches an apparatus 10 for the compressive treatment of a web 12 of fibrous thread interlaced web material that is fed by a first roll 14 having an outer convex surface 16 and which rotates in a direction shown by an arrow 18. A second roll 20 is positioned adjacent the first roll 14 to form a nip 22 therebetween. The second roll 20 has an outer surface 24 and rotates in the direction shown by arrow 26. The outer convex surface 16 of the first roll 14 and the outer convex surface 24 of the second roll 20 move in opposite directions in the nip 22. A confining apparatus, henceforth referred to as a shoe, 28 is positioned above the first roll 14 and the second roll 20. The shoe 28 has a gull-wing shape formed by a first wing 30 and a second wing 32 that meet at an arcuate apex, henceforth referred to as a critical lower edge, 34. The first wing 30 of the shoe 28 adjacent to the first roll 14 follows the outer convex surface 16 of the first roll 14 closely in a first portion, to thereby maintain a substantially constant spacing of the first wing 30 of the shoe 28 from the first roll 14. In a second portion that forms a precompacting zone 36, however, the spacing of the first wing 30 of the shoe 28 increases. Depth of the precompacting zone 36 is equal to the original spacing of the first wing 30 of the shoe 28 from the first roll 14 in the first portion, plus the original thickness of the web 12, however, it may be slightly smaller. Also, the length of a recess is not less than three times the original thickness of the web 12 and, preferably, twenty times the original thickness of the web 12. This structure allows the web 12 to thicken slightly by collecting in the precompacting zone 36 to provide controlled shrinkage.

More specifically, the shoe 28 further has an entire length, and a top surface 38 with a pair of ends 40 and a center 42. The first wing 30 of the shoe 28 has a first radius of curvature 44 and the second wing 32 of the shoe 28 has a second radius of curvature 46, and both depend concavingly from the pair of ends 40 of the top surface 38 of the shoe 28, respectively, to the critical lower edge 34 of the shoe 28. The first radius of curvature 44 of the first wing 30 of the shoe 28 is less than the second radius of curvature 46 of the second wing 32 of the shoe 28. The top surface 38 of the shoe 28 further has a channel 48. The channel 48 of the top surface 38 of the shoe 28 depends in the top surface 38 of the shoe 28, at the center 42 of the top surface 38 of the shoe 28, is rectilinear-shaped, extends along the entire length of the shoe 28, and carries a coolant 49.

(15) European Patent Application Publication Number 87117160.9 to Walton.

European Patent Application Publication Number 87117160.9—published to Walton on May 25, 1988 in International class B31F and subclass 1/12—teaches a machine and method for longitudinally compressing a web under an influence of driving forces provided at a nip line defined by spaced-apart pairs of matched rotating disks and under the influence of retarding forces provided by sets of retarding fingers inserted in the space between the disks. Close to the nip line, web-contacting surfaces of the sets of retarding fingers diverge in a direction of travel of the web, whereby the longitudinally compressed web is subjected to a lightest constraint of its thickness at a point longitudinally close to the nip line and downstream therefrom. While still confined, the corresponding sections of the web are released from lightest constraint, with the diverging surfaces promoting uniform movement of the corresponding oncoming sections of compressed web while enabling relatively steady retarding forces to be transmitted laterally through the web to retard adjacent sections of the web that are inline with the disks, whereby longitudinal compressive treatment of both the sections of the web inline with the fingers and the sections inline with the disks can be substantially regular. The retarding fingers extend as cantilevers upstream toward the nip line and are integral extensions of a continuous metal sheet that engages the treated web in its outward movement. A dwell cavity that lightly confines the web aids in the setting of the treatment and enables high speed throughout.

(16) U.S. Pat. No. 5,012,562 to Catallo.

U.S. Pat. No. 5,012,562—issued to Catallo on May 7, 1991 in U.S. class 26 and subclass 18.6—teaches an apparatus for compressive shrinking of fibrous materials. The apparatus uses a system of moving surfaces of different speeds cooperating with a confining blade spaced from the movable surface or surfaces to cooperate to form a stuffing chamber for compaction of the fibrous material. An impact blade is provided to facilitate compression of the fibrous material, and the blade includes an apparatus for achieving straightness of the blade.

(17) U.S. Pat. No. 5,016,329 to Milligan et al.

U.S. Pat. No. 5,016,329—issued to Milligan et al. on May 21, 1991 in U.S. class 26 and subclass 18.5—teaches an apparatus for compressive lengthwise shrinking of tubular knitted fabrics and other materials, particularly, in a single stage. Feeding and retarding rollers are separated from each other by a distance significantly greater than the thickness of the fabric. Zone-forming blades are projected between the feeding and the retarding rollers from opposite sides, and form between them, a confinement zone that extends at a large angle from the feeding roller to the retarding roller. The fabric is guided to the confinement zone under low contact pressure by the feeding roller and is conveyed away from the confinement zone under similarly low contact pressure by the retarding roller. At an entrance to the confinement zone, the fabric is decelerated and compacted lengthwise without burnishing or abrasion and without crimping. Tubular and open width knitted fabrics can be compressively preshrunk in large amounts, up to 25% and more, in a single stage.

(18) U.S. Pat. No. 5,117,540 to Walton et al.

U.S. Pat. No. 5,117,540—issued to Walton et al. on Jun. 2, 1992 in U.S. class 26 and subclass 18.6—teaches machines and methods for longitudinal compressive treatment of a web. A retarder blade, disposed adjacent a roll, provides a web-contacting slide surface to which the longitudinally compressed web transfers and upon which it slides as it leaves the roll. The retarder blade has two spaced-apart and roll-contacting regions disposed toward the roll. One of the roll-contacting regions is disposed at the forward tip of the blade near the drive region, and the second roll-contacting region is disposed at a heel region spaced downstream. A pair of drive rolls define a nip therebetween and are for driving the web forward. The surface of each of the rolls includes a series of principle web-gripping grooves extending in only one direction helically about the roll axis. At the nip line of the rolls, the angle of the grooves of one roll is inclined positively relative to the direction of travel of the web, and the angle of the grooves of the other roll is inclined negatively relative to the direction of travel of the web. Roll contours, forms of the blade construction, and other features of the driving and retarding passages are further taught.

(19) U.S. Pat. No. 5,553,365 to Catallo.

U.S. Pat. No. 5,553,365—issued to Catallo on Sep. 10, 1996 in U.S. class 26 and subclass 18.6—teaches an apparatus for compressive shrinking of fibrous web materials. The apparatus uses a system of moving rolls of different speeds cooperating with a confining member to form a stuffing chamber wherein a web material moves in a passageway where the web is compacted. An additional apparatus for moving the rolls to provide a substantially uniform dimension to the passageway facilitates the compaction of the web material.

(20) U.S. Pat. No. 6,681,461 B1 to Catallo.

U.S. Pat. No. 6,681,461 B1—issued to Catallo on Jan. 27, 2004 in U.S. class 26 and subclass 18.6—teaches a method and related apparatus for shrink-proofing a fabric, typically a knitted textile composed of interlocked loops of yarn made of natural and/or man-made fibers. The loops interlock along stitch rows that may become skewed. The fabric is confined from expanding as the fabric is delivered to, and discharged from, an in-line compression zone free of obstructions, such as, crimps, bends, or kinks. The fabric is confined, preferably resiliently, coming to, passing through, and leaving the compression zone so as to accommodate variation of thickness and irregularities of the fabric being compacted in the compression zone. The interlocked loops are organized, whereby the interlocked loops are allowed to move toward each other orthogonally along their related stitch row so as to reduce volume of the fabric. Non-woven textiles, papers, papers with additives, and the like are shrink-proofed in the same manner.

(21) U.S. Pat. No. 7,395,587 B2 to Catallo et al.

U.S. Pat. No. 7,395,587 B2—issued to Catallo et al. on Jul. 8, 2008 in US class 26 and subclass 18.6—teaches devices for adjusting positions of a removable slip sheet in a compression zone defined by a pair of rollers of an open width textile compressive shrinking machine to adjust a size of the compression zone for various thickness and types of textiles. A wedge, between the pair of rollers, spaces apart the pair of rollers a predetermined dimension. A shoe, in the compression zone, allows for different thickness and types of textiles.

(22) U.S. Pat. No. 8,590,122 B2 to West et al.

U.S. Pat. No. 8,590,122 B2—issued to West et al. on Nov. 26, 2013 in U.S. class 26 and subclass 18.6—teaches a two-stage process and apparatus for compacting tubular knitted fabrics. At each stage, the fabric is acted upon by cooperating feeding and retarding rollers spaced-apart a distance greater than the thickness of the fabric. Opposite fabric sides, thus, cannot be in simultaneous contact with the feeding and the retarding rollers at a same point along the fabric. The fabric is transferred from the feed roller to the retarding roller, while opposite sides of the fabric are closely confined in a compacting zone and free of contact with either roller. The fabric is longitudinally compacted during its traverse of that zone. In the second stage, the rollers are reversely oriented with respect to the fabric. Unlike known two-stage procedures, not more than 60% of the compacting effort is imparted in either one of the stages. Preferably, each stage imparts about 50% of the compacting effort.

It is apparent that numerous innovations for shoe-utilized fabric compactors have been provided in the prior art, which are adapted to be used. Furthermore, even though these innovations may be suitable for the specific individual purposes to which they address, nevertheless, they would not be suitable for the purposes of the embodiments of the present invention as heretofore described, namely, a shoe for a compactor and for avoiding heat deformation thereof.

2. SUMMARY OF THE INVENTION

Thus, an object of the embodiments of the present invention is to provide a shoe for a compactor, which avoids the disadvantages of the prior art.

Briefly stated, another object of the embodiments of the present invention is to provide an improved compactor shoe of the type having a gull-wing shape formed by a first wing and a second wing that meet at a critical lower edge, and a top surface. The first wing has a first radius of curvature and the second wing has a second radius of curvature, and both depend concavingly from the top surface to the critical lower edge. The first radius of curvature of the first wing is less than the second radius of curvature of the second wing. The improvement includes a through bore extending axially through the shoe, which carries a coolant to avoid heat deformation of the critical lower edge.

The novel features considered characteristic of the embodiments of the present invention are set forth in the appended claims. The embodiments of the present invention themselves, however, both as to their construction and to their method of operation together with additional objects and advantages thereof will be best understood from the following description of the embodiments of the present invention when read and understood in connection with the accompanying figures of the drawing.

3. BRIEF DESCRIPTION OF THE FIGURES OF THE DRAWING

The figures of the drawing are briefly described as follows:

FIG. 1 is a diagrammatic side elevational view of prior art U.S. Pat. No. 4,689,862 to Catallo;

4. LIST OF REFERENCE NUMERALS UTILIZED IN THE FIGURES OF THE DRAWING

A. Prior Art

Figure 1:
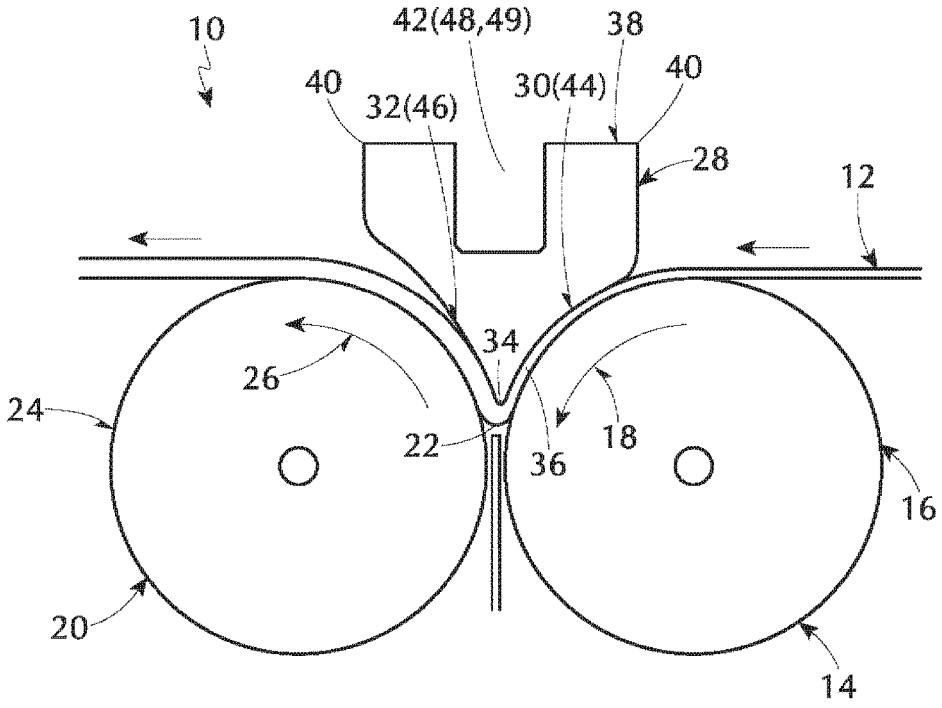
FIG. 1 PRIOR ART

10 apparatus for compressive treatment of web 12 of fibrous thread interlaced web material

12 web
14 first roll
16 outer convex surface of first roll 14
18 arrow of first roll 14
20 second roll
22 nip
24 outer surface of second roll 20
26 arrow of second roll 20
28 shoe
30 first wing of shoe 28
32 second wing of shoe 28
34 critical lower edge of shoe 28
36 precompacting zone
38 top surface of shoe 28
40 pair of ends of top surface 38 of shoe 28
42 center of top surface 38 of shoe 28
44 first radius of curvature of first wing 30 of shoe 28
46 second radius of curvature of second wing 32 of shoe 28
48 channel of top surface 38 of shoe 28
49 coolant B. Introductory

128 shoe of embodiments of present invention.

C. Configuration of Shoe 128

130 first wing of shoe 128
132 second wing of shoe 128
134 critical lower edge of shoe 128
138 top surface of shoe 128
140 pair of ends of top surface 138 of shoe 128
142 center of top surface 138 of shoe 128
144 first radius of curvature of first wing 130 of shoe 128
146 second radius of curvature of second wing 132 of shoe 128
148 channel of top surface 138 of shoe 128
149 coolant for avoiding heat deformation of critical lower edge 134 of shoe 128

D. Improvement

150 through bore of shoe 128 for carrying coolant 149 for avoiding heat deformation of critical lower edge 134 of shoe 128

5. DETAILED DESCRIPTION OF THE PREFERRED EMBODIMENTS

A. Introductory

Figure 2:
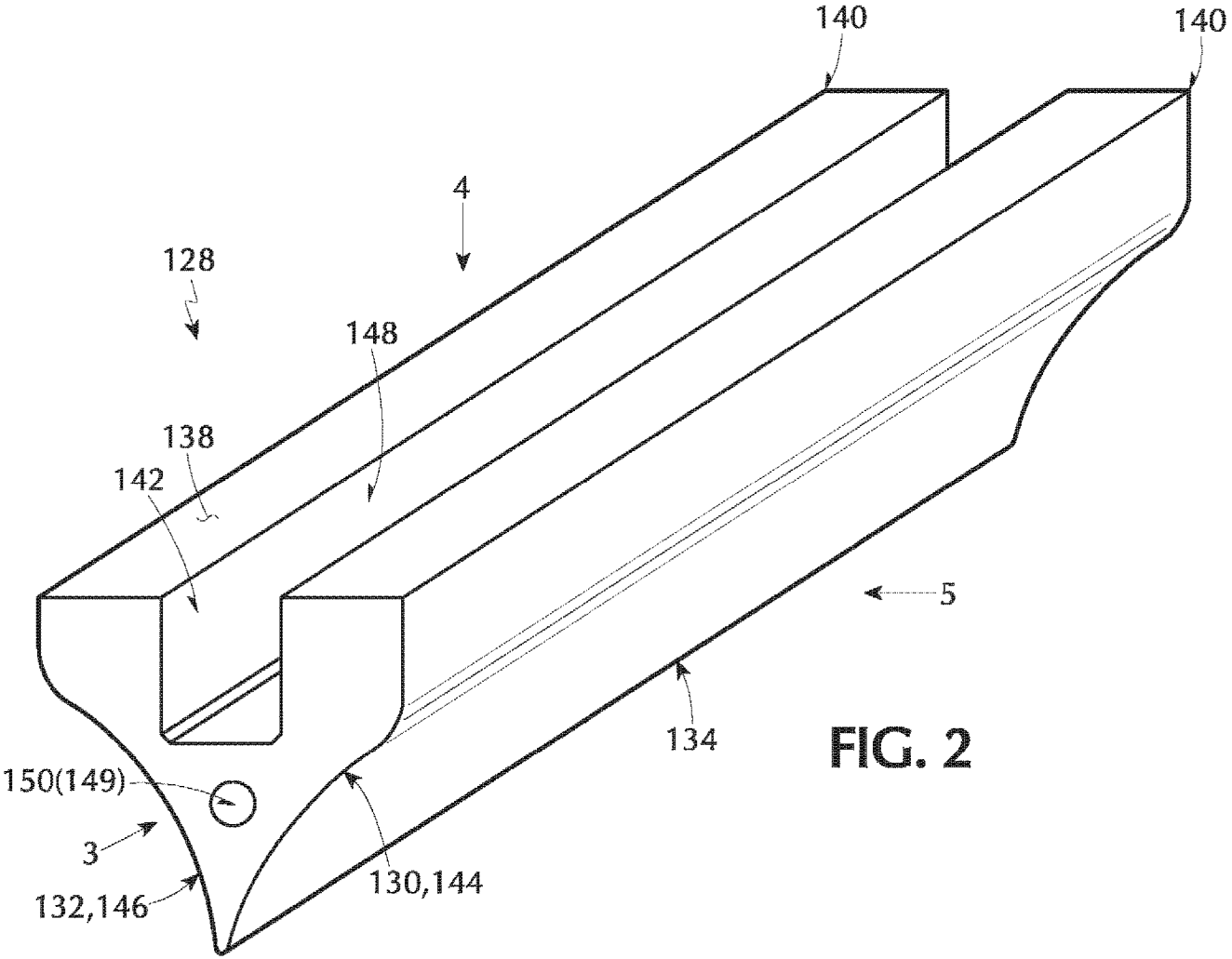
FIG. 2 is a diagrammatic perspective view of the compactor shoe of the embodiments of the present invention.
Figure 3:
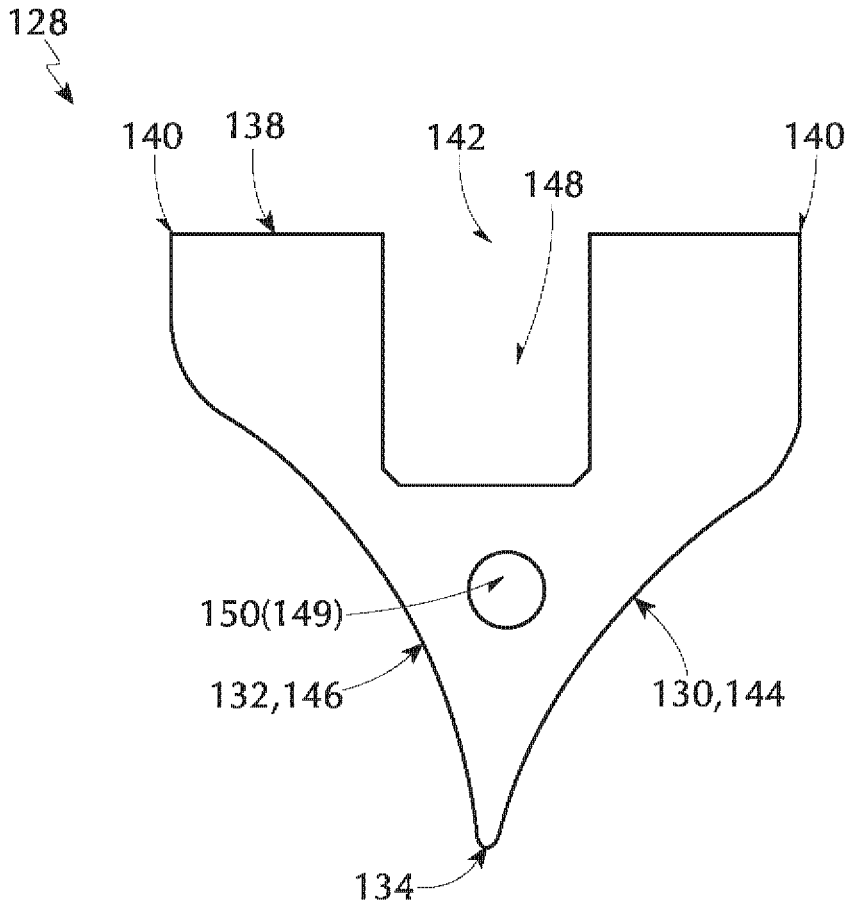
FIG. 3 is a diagrammatic end elevational view taken in the direction of ARROW 3 in FIG. 2.
Figure 4:
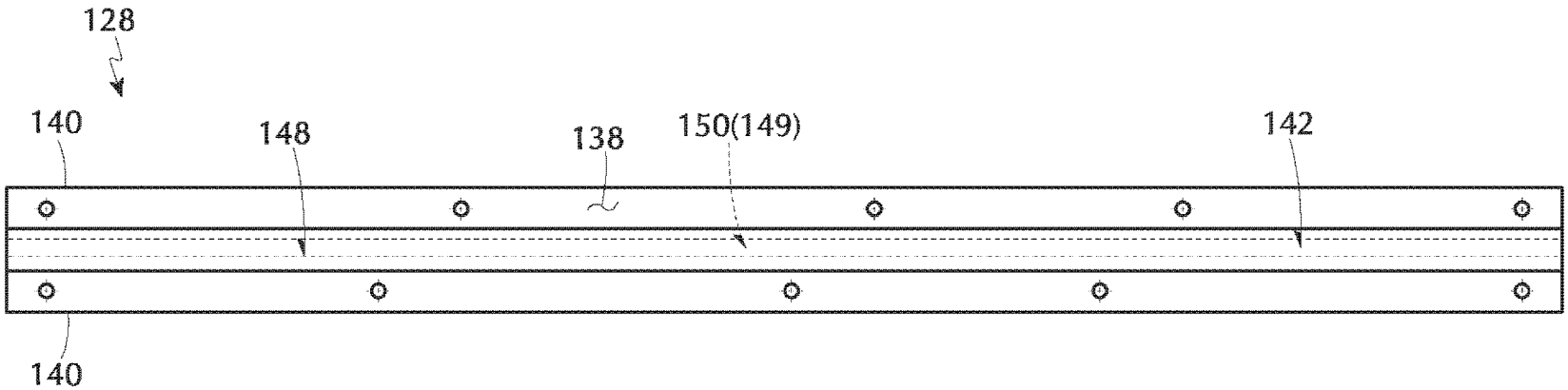
FIG. 4 is a reduced diagrammatic top plan view taken in the direction of ARROW 4 in FIG. 2.
Figure 5:
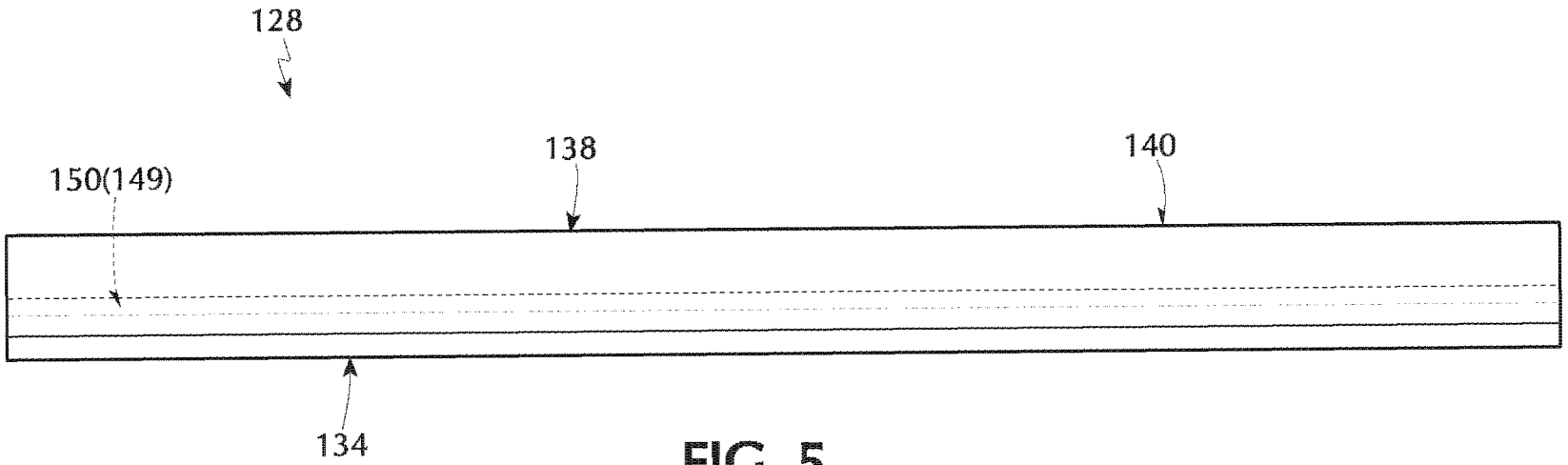
FIG. 5 is a reduced diagrammatic side elevational view taken in the direction of ARROW 5 in FIG. 2.

Referring now to FIG. 2, the shoe of the embodiments of the present invention is shown generally at 128.

B. The Configuration of the Shoe 128

The configuration of the show 128 can best be seen in FIGS. 2-5, and as such, will be discussed with reference thereto.

The shoe 128 has a gull-wing shape formed by a first wing 130 and a second wing 132 that meet at an arcuate apex, henceforth referred to as a critical lower edge, 134.

The shoe 128 further has an entire length, and a top surface 138 with a pair of ends 140 and a center 142.

The first wing 130 of the shoe 128 has a first radius of curvature 144 and the second wing 132 of the shoe 128 has a second radius of curvature 146, and both depend concavingly from the pair of ends 140 of the top surface 138 of the shoe 128, respectively, to the critical lower edge 134 of the shoe 128.

The first radius of curvature 144 of the first wing 130 of the shoe 128 is less than the second radius of curvature 146 of the second wing 132 of the shoe 128.

The top surface 138 of the shoe 128 further has a channel 148.

The channel 148 of the top surface 138 of the shoe 128 depends in the top surface 138 of the shoe 128, at the center 142 of the top surface 138 of the shoe 128, is rectilinear-shaped, and extends along the entire length of the shoe 128.

C. The Improvement

The shoe 128 further has a through bore 150.

The through bore 150 of the shoe 128 extends axially and completely therethrough.

The through bore 150 of the shoe 128 is disposed between the channel 148 of the top surface 138 of the shoe 128 and, and in close proximity to, the critical lower edge 134 of the shoe 128 and is for carrying a coolant 149 for avoiding heat deformation of the critical lower edge 134 of the shoe 128.

The through bore 150 of the shoe 128 is cylindrically shaped for providing a smooth flow of the coolant 149 by avoiding obstructions, such as, but not limited to, corners and edges.

D. Impressions

It will be understood that each of the elements described above or two or more together may also find a useful application in other types of constructions differing from the types described above.

While the embodiments of the present invention have been illustrated and described as embodied in a shoe for a compactor, nevertheless, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. An improved compactor shoe of the type having a gull-wing shape formed by a first wing and a second wing that meet at a critical lower edge, and a top surface with a channel, wherein the first wing has a first radius of curvature and the second wing has a second radius of curvature, wherein the first wing and the second wing depend concavingly from the top surface to the critical lower edge, and wherein the first radius of curvature of the first wing is less than the second radius of curvature of the second wing, said improvement comprising:

a) a coolant; and b) a through bore;

said through bore extending through said shoe;

said through bore carries said coolant for avoiding heat deformation of the critical lower edge of the shoe; and said through bore of the shoe being disposed midway between the first radius of curvature of the first wing and the second radius of curvature of the second wing and being offset from an imaginary line drawn from the critical lower edge perpendicular to the channel.

2. The improved compactor shoe of claim 1, wherein said improvement further comprises said through bore of said shoe extending axially therethrough.

3. The improved compactor shoe of claim 1, wherein said improvement further comprises said through bore of said shoe extending completely therethrough.

4. The improved compactor shoe of claim 1, wherein said improvement further comprises said through bore of said shoe being disposed between the channel of the top surface of said shoe and the critical lower edge of said shoe.

5. The improved compactor shoe of claim 1, wherein said improvement further comprises said through bore of said shoe being disposed in proximity to the critical lower edge of said shoe to carry said coolant for avoiding heat deformation of the critical lower edge.

6. The improved compactor shoe of claim 1, wherein said improvement further comprises said through bore of said shoe being cylindrically shaped to provide a smooth flow of said coolant.

7. A shoe for a compactor, comprising:

a) a gull-wing shape formed by a first wing and a second wing that meet at a critical lower edge;

b) a top surface with a channel;

c) a through bore; and d) a coolant;

wherein said through bore extends through said shoe;

wherein said through bore carries said coolant for avoiding heat deformation of said critical lower edge; and wherein said through bore of said shoe is disposed midway between a first radius of curvature of said first wing and a second radius of curvature of said second wing and is offset from an imaginary line drawn from said critical lower edge perpendicular to the channel.

8. The shoe of claim 7, wherein said through bore extends axially through said shoe.

9. The shoe of claim 7, wherein said through bore extends completely through said shoe.

10. The shoe of claim 7, wherein said through bore is disposed between said channel of said top surface and said critical lower edge.

11. The shoe of claim 7, wherein said through bore is disposed in proximity to said critical lower edge to carry said coolant for avoiding heat deformation of said critical lower edge.

12. The shoe of claim 7, wherein said through bore is cylindrically shaped to provide a smooth flow of said coolant.

13. The shoe of claim 7, further comprising an entire length;

wherein said top surface has:

a) a pair of ends; and b) a center.

14. The shoe of claim 7, wherein said first radius of curvature of said first wing is less than said second radius of curvature of said second wing.

15. The shoe of claim 13, wherein said first wing and said second wing depend concavingly from said pair of ends of said top surface, respectively, to said critical lower edge.

16. The shoe of claim 13, wherein said channel of said top surface is disposed at said center of said top surface.

17. The shoe of claim 7, wherein said channel of said top surface is rectilinear-shaped.

18. The shoe of claim 13, wherein said channel of said top surface extends along said entire length of said shoe.

* * * * *